United States Patent [19]

Scholl et al.

[11] 4,006,698

[45] Feb. 8, 1977

[54] SEWING DEVICE FOR PERFORMING SEAMS ON SIMILAR WORKPIECES OF DIFFERENT LENGTH

[75] Inventors: Hans Scholl, Oerlinghausen-Lipperreihe; Wolfgang Sugland, Herford; Jochen Fischer, Brackwede, all of Germany

[73] Assignee: Kochs Adler AG, Bielefeld, Germany

[22] Filed: Jan. 17, 1975

[21] Appl. No.: 541,784

[52] U.S. Cl. ..... 112/121.11; 112/121.14

[51] Int. Cl.[2] ..... D05B 19/00; D05B 3/00

[58] Field of Search ..... 112/121.12, 121.11, 112/121.15, 121.29, 130, 121.14, 102, 103, 118, 119

[56] References Cited

UNITED STATES PATENTS

| | | | |
|---|---|---|---|
| 3,216,380 | 11/1965 | Bono | 112/121.12 |
| 3,407,759 | 10/1968 | Scholl et al. | 112/121.12 |
| 3,440,980 | 4/1969 | Bono | 112/121.12 |
| 3,739,733 | 6/1973 | Schramayr | 112/121.12 |
| 3,762,348 | 10/1973 | Junemann | 112/121.12 |
| 3,895,590 | 7/1975 | Perlino | 112/121.12 |

*Primary Examiner*—H. Hampton Hunter
*Attorney, Agent, or Firm*—Jacob L. Kollin

[57] ABSTRACT

A sewing device for sewing similar workpieces of alternate sizes, the device is provided with means for the positioning control and the insertion of the workpiece cuts to be sewn, into the workpiece clamping holders. To adapt the device for workpieces of other sizes, there are provided adjusting means for the simultaneous displacement of two-piece clamping holders, master cams and the stop dogs of an inserting device.

4 Claims, 7 Drawing Figures

SEWING DEVICE FOR PERFORMING SEAMS ON SIMILAR WORKPIECES OF DIFFERENT LENGTH

BACKGROUND OF THE INVENTION

The invention relates to a sewing device for forming seams on similar workpieces, but of different length. The device is provided with two substantially symmetrically formed workpiece clamping holders adjustable relative to each other according to the length of the workpiece, a master cam comprising two symmetrically formed external segments which are connected by a bridging rail for forming a continued edge. Along the profile of the cam edge on the master cam rolls a driven magnetic roller which controls the sewing machine, and a device for the positioning control and for inserting the workpiece cuts to be sewn into the workpiece clamping holders and simultaneously removing the finished workpieces therefrom.

U.S. Pat. No. 3,216,380 discloses an automatic operating sewing machine for sewing of like patterns of different lengths, which comprises a fabric holder adjustable in a predetermined direction and in accordance with the desired shape of sewing, for effecting the movements of the fabric holders, a pattern including two end positions and a bridging intermediate portion which is adjustably movable along a straight line relative to each other by means of a threaded spindle operated by a hand wheel. However variation of the workpiece sizes requires a manual resetting of one of the two fabric holder parts.

There is further disclosed in U.S. Pat. No. 3,407,759 a sewing device which is provided with a rotary table and clamping means for receiving workpiece cuts to be processed and successively fed into the effective range of tooling machines, e.g. a sewing machine and a cutting machine due to the rotation of the rotatary table. The table is provided with radially disposed segments, each carrying templates for engaging with a magnetic roller which is coaxial with the needle of the sewing machine and the clamping means for a right and a left half of two neighbouring workpieces. These segments are radially displaceable as per a scale by means of a control adjusting device.

However, the aforesaid known devices do not include means for inserting of previously aligned workpiece cuts into the opened workpiece clamping means, quick-adjusting means for sewing similar workpiece cuts of different length, and for simultaneously removing of sewn workpieces out of the workpiece clamping means.

It is an object of this invention to provide an automatically operating sewing device of the above mentioned kind with central quick-adjusting means for the changeover to any different workpiece sizes or dimensions.

It is a further object of the invention to provide said sewing device with means for inserting workpiece cuts to be sewn into the opened workpiece clamping holders and simultaneously removing of a sewn workpiece out of the same holder.

Other objects and advantages of the present invention will become apparent from the following description in conjunction with the attached drawings which illustrate a preferred embodiment.

DESCRIPTION OF THE PREFERRED EMBODIMENT

Figure 1:
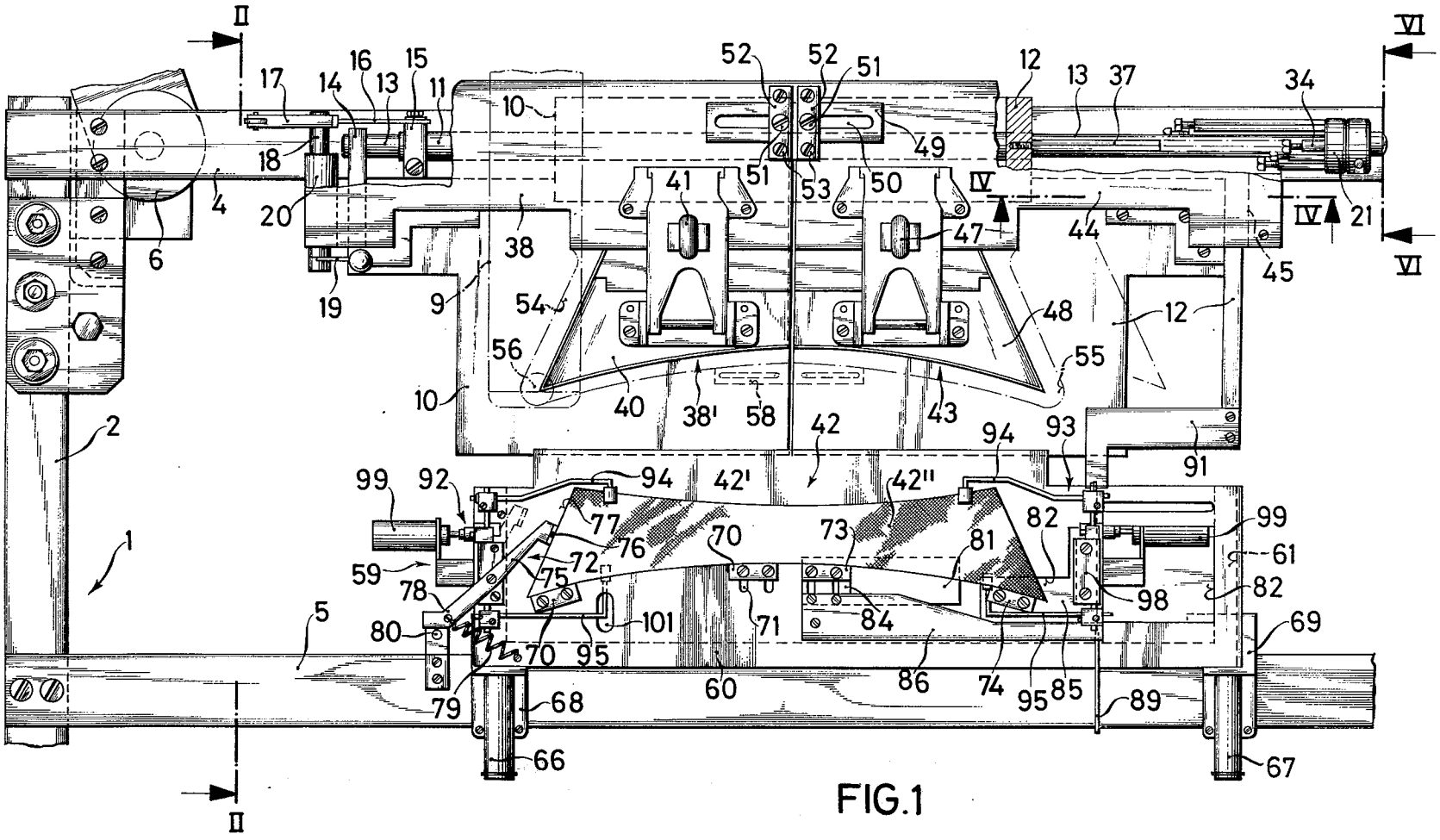
FIG. 1 is a top plan view of an automatic sewing device provided with positioning and inserting means for feeding the workpiece cuts to be sewn into the workpiece clamping holders.

Pivoted to the frame 1 of the sewing device having a left frame section 2 (FIG. 1), a right frame section 3 (FIG. 3) and two connecting girders 4, 5, is a link arm 6, which is linked by means of a connecting arm 7 to a supporting arm 9 carrying a sewing machine 8.

Mounted fixedly on the connecting girder 4 is a left carrier body 10 (FIGS. 1 and 2), in which is slidably received a tube 11 carrying a right carrier body 12 (FIGS. 1, 3, 4 and 6).

Figure 5:
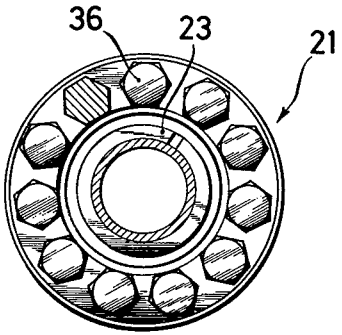
FIG. 5 is a section taken along line V—V of FIG. 4.

The tube 11 is slidably arranged on a rod 13, which is mounted on the connecting girder 4 of the frame 1 (FIG. 1) by means of a bearing block 14. On the tube 11 is located a clamping member 15, to which is hinged a connecting rod 16 connected with a lever 17. The latter is hinged to shaft 18 provided with a hand lever 19 and pivoted in a support 20, which is secured to the left carrier body 10. On the free end of the rod 13 is disposed a limit stop carrier 21 (FIGS. 1, 4 and 5) which is pivoted to a bush 23 clampled to the rod 13 and having a flange 22. Adjacent to the limit stop carrier 21 having a clamping slot 24 (FIGS. 4, 6) is arranged on the bush 23 a clamping member 25 which is also formed with a slot 27, for clamping the clamping member 25 and the bush 23 to the rod 13 by means of a clamping screw 26.

Received in a recess 28 in the clamping member 25, is a ball 29 tensioned by a pressure spring 30 and cooperating with bores 31, which serve as latches and are arranged at the front side of the limit stop carrier 21 facing the clamping member 25. Into the other frontal area of the limit stop carrier 21 are cut tapholes 33, in which the bores 31 terminate and which serve for receiving of adjustable limit stops 34, 34' 34'' of different lengths. In the free ends of the adjustable limit stops are inserted adjustable stop screws 36, which are secured against rotation by means of springs 35 and can be brought into the path of motion of a stop 37 located in the right carrier body 12.

Arranged on the support 20 connected with the stationary left carrier body 10, is a plate 38 for receiving a stationary workpiece clamping half 38' comprising a left lower clamping plate 39 (FIG. 2) and a left upper clamping plate 40 liftable by means of a compressed air cylinder 41, and serving for receiving the left halves 42' of the workpiece cuts 42 to be sewn. For receiving the right halves 42'' of the workpiece cuts 42, there is provided a movable workpiece clamping holder 43 (FIGS. 1 and 3), which is carried by a plate 44. The plate 44 is secured to a carrier 45 connected with the right carrier body 12 and provided with a right lower clamping plate 46 and a right upper clamping plate 48 liftable by means of a compressed air cylinder 47. The right workpiece half 42'' is clamped between the lower and upper clamping plates 46, 48.

Both plates 38, 44 are bridged by a rail 49 (FIGS. 1 and 2) formed with an oblong hole 50 and displaceably secured by means of screws 51 to the plates 38, 44. The rail is laterally guided in guide pieces 52 secured to the plates 38, 44 by means of screws 53.

Disposed underneath the carrier bodies 10 and 12 are two master cam halves 54 and 55 (FIGS. 1 and 3) arranged along the profile of which rolls a motor-driven magnetic roller 56, which is located in the supporting arm 9 and the axis of which extends coaxially to the needle 57 of the sewing machine 8. Both master cam halves 54 and 55 are connected by means of a bridging rail 58 (FIG. 1) along which the magnetic roller 56 rolls when shifting from one cam half to the other one.

Figure 2:
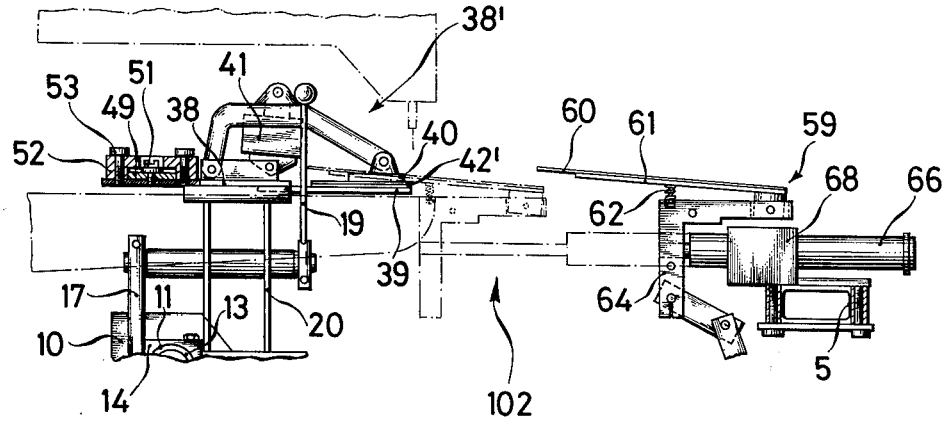
FIG. 2 is a section taken along line II—II of FIG. 1.
Figure 3:
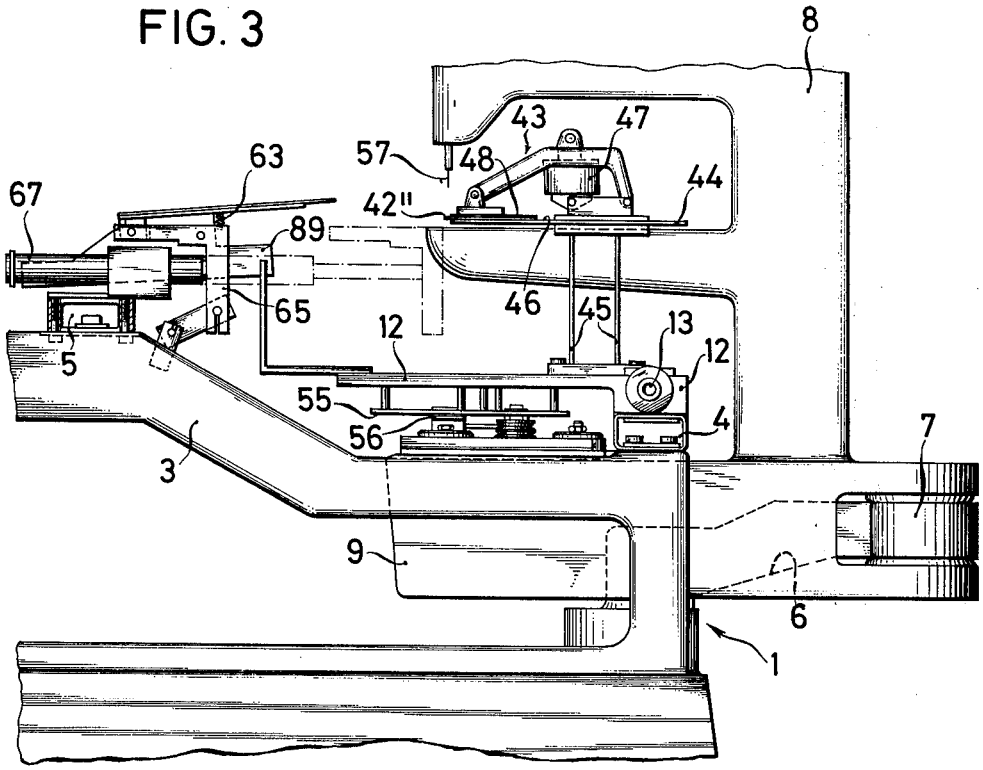
FIG. 3 is a partial right side elevation of the unit.
Figure 4:
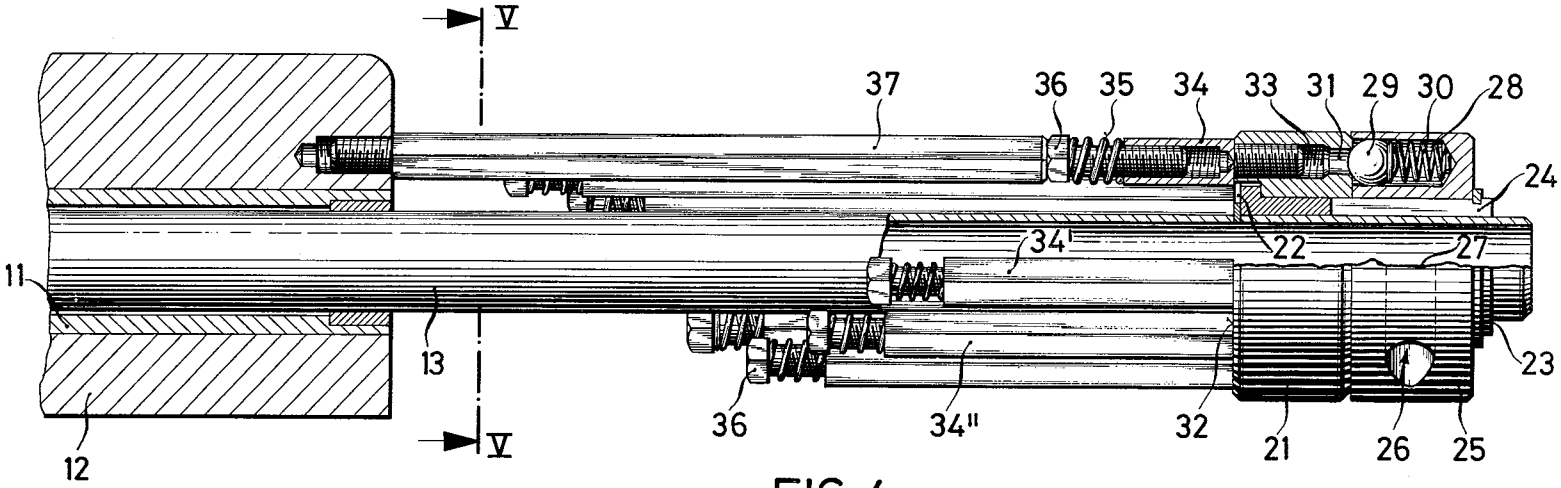
FIG. 4 is a partial section taken along line IV—IV of FIG. 1, on an enlarged scale.
Figure 6:
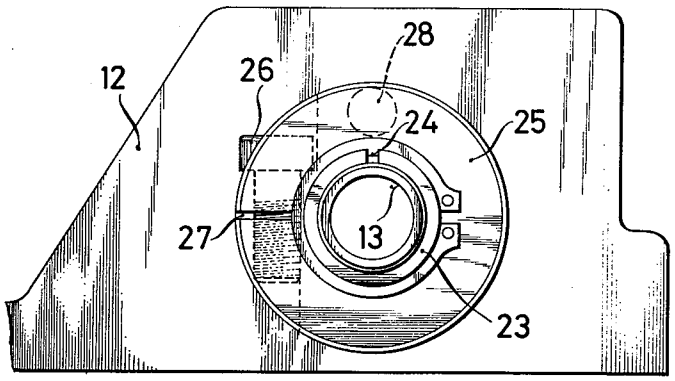
FIG. 6 is a partial side elevation taken along line VI—VI of FIG. 1, on an enlarged scale.

Disposed on the connecting girder 5 of the frame 1 is device 59 for properly inserting the workpiece, the workpiece cuts 42 to be sewn into and sewn workpieces out of the clamping holders 38', 42. The device 58 comprises a workpiece holding plate 60 receiving the workpiece cuts 42 and secured to a frame 61 (FIGS. 1 to 3), which is pivoted to two angle pieces 64, 65 and swingable into a horizontal position against the tension of springs 62, 63 (FIGS. 2 and 3). The angle pieces 64, 65 together with the workpiece holding plate 60 are displaceably supported by means of telescopic guides 66, 67 received in bearing blocks 68, 69, which are secured to the connecting girder 5.

In order to properly position the workpiece cuts 42 to be sewn on the workpiece holding plate 60 with respect to the stationary workpiece clamping half 38', there are provided stop dogs 70 which are adjustably and fixably received in oblong holes 71 formed in the workpiece holding plate 60, for determining the position for the front edge of the left half 42' of the workpiece cuts 42, and a swingable stop 72 for determining the position for the lateral workpiece cut edges 77. The swingable stop 72 comprises a two-armed lever 75 pivoted to the workpiece holding plate 60. One arm of the lever 75 is formed with a bearing surface 76 for the lateral workpiece cut edges 77, whereas, if the workpiece holding plate 60 is in the normal position as shown in FIG. 1, the free arm 78 rests under tension of a spring 79 against a stop 80 arranged on the connecting girder 5.

The workpiece holding plate 60 (FIGS. 1 and 7) is provided with two recesses 81, 82 in which are received supporting plates 84, 85 flushing with the workpiece plate 60 and having oblong holes 83 for adjusting and fixing stops 73 and 74 which determine the position for the front edge of the right workpiece cut halves 42''. The supporting plates 84, 85 are disposed between two plates 86, 87 (FIG. 7) and secured to them by means of screws 88. Connected to the lower plate 87 is a rail 89 (FIGS. 3 and 7) extending downwards and engaging in a slot 90 formed in the end of an engaging piece 91 which is secured to the right carrier body 12.

Received in the workpiece holding plate 60 recesses 81, 82 are supporting plates 84, 85 having oblong holes 83 for securing the stops 73, 74 and flush with the workpiece holding plate 60. The supporting plates 84, 85 are disposed between two plates 86, 87 and secured to them by means of screws 88. Connected to the lower plate 87 is a rail 89 (FIGS. 3 and 7) extending vertically downwards from the latter.

Secured to the right carrier body 12 is an engaging piece 91 formed at its end with a slot 90 engaging in the rail 89.

Figure 7:
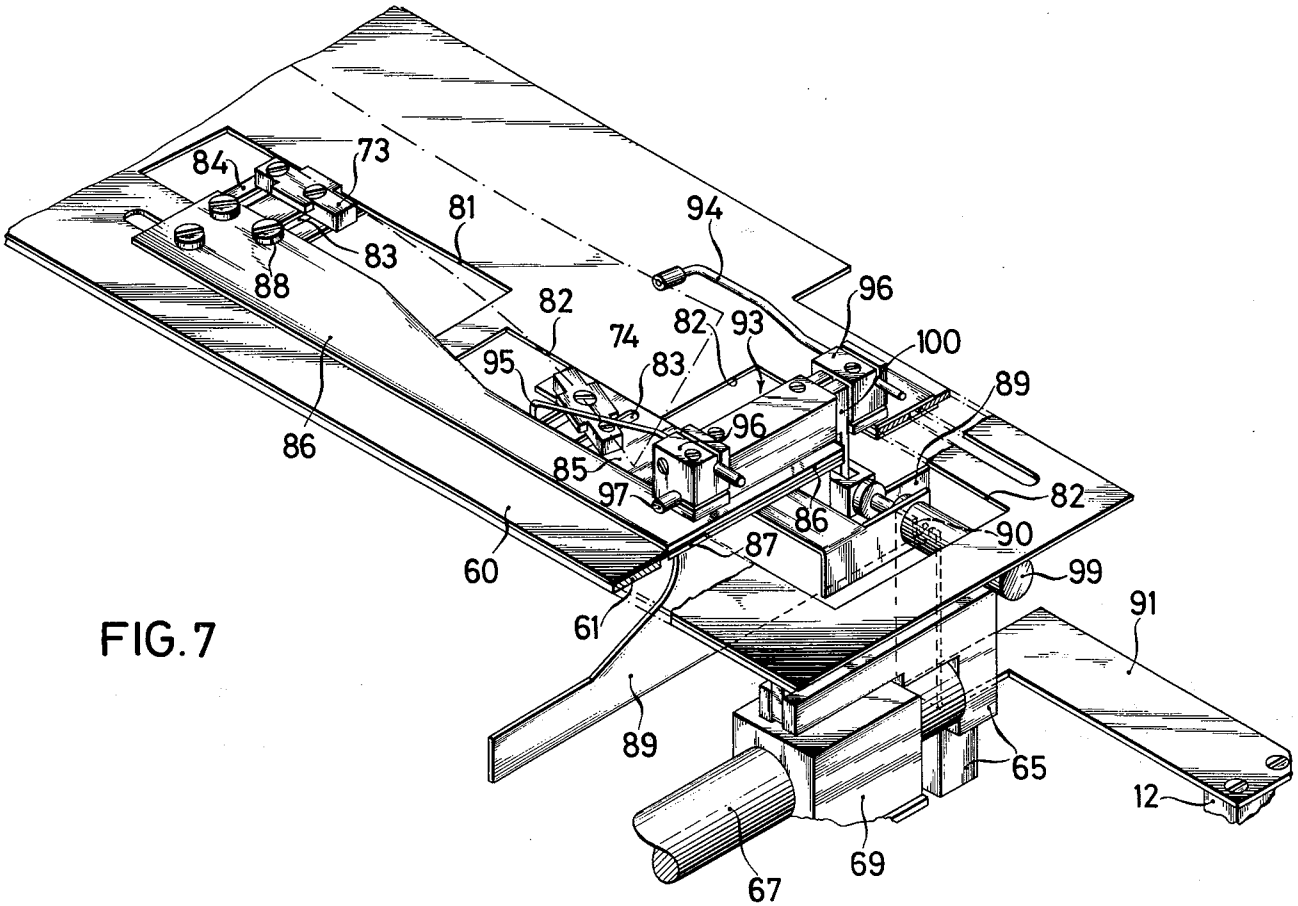
FIG. 7 is a perspective partial top view on the inserting device.

Disposed on the workpiece holding plate 60 are two clamping devices 92, 93 (FIGS. 1 and 7). The clamping device 92 is fixedly mounted on the left side of workpiece holding plate 60, whereas the second clamping device 93 is received by the plates 86, 87 and displaceable with the latter and the supporting plates 84 85. The clamping devices 92, 93 are formed with an upper clamping arm 94 (FIG. 7) and a lower clamping arm 95, which are slidably received in securing members 96 clamped to a shaft 97. The shaft 97 is pivoted in a block 98 and in driving connection with an air cylinder 99 or magnet by means of a lever 100. The lower clamping arm 95 is offset and projects through the recess 82 formed in the workpiece holding plate 60 respectively through a recess 101 (FIG. 1) in order to cooperate with the underside of the workpiece holding plate 60, if the upper clamping arm 94 is in a lifted position.

Operation of the sewing unit is as follows:

The sewing device destined for sewing similar collars but of different length, is according to the FIG. 1 set for the smallest collar size. To feed the device, the workpiece cuts 42 are placed upon the workpiece holding plate 60, while the clamping arms 94 are lifted, in such a manner, that the lateral workpiece edge 77 abuts against the bearing surface 76 of the two-armed lever 75 and the longitudinal edge at the stops 70, 73, 74. Subsequently, the upper clamping arms 94 are lowered on the workpiece cuts 42, while simultaneously, the lower clamping arms 95 are lowered from the underside of the workpiece supporting plate 60.

By means of the shifting device, which is denoted in FIG. 2 with the Ref. No. 102, the angle pieces 64 carrying the workpiece holding plate 60 and thus also the workpiece cuts 42, are shifted to the workpiece clamping holders 38, 43, at this the upper clamping plates 40, 48 are lifted from the lower clamping plates 39, 46 by means of the compressed air cyliners 41, 47, in order to provide the required space between a sewn workpiece lying upon the lower clamping plates 39, 46 and the upper clamping plates 40, 48, for inserting the workpiece holding plate 60 and the workpiece cuts 42 to be sewn. After that, the upper clamping plates 40, 48 will be lowered upon the workpiece cuts 42 at which the latter are pressed tightly by means of the springs 62, 63 between the workpiece holding plate 60 and the upper clamping plates 40, 48. Now the upper clamping arms 94 will be lifted by means of the air cylinders 99 in order to release the inserted workpiece cuts 42 and simultaneously clamp the sewn workpiece with its longitudinal edge against the underside of the workpiece holding plate 60 by means of the lower clamping arms 95. Then the workpiece holding plate 60 together with the sewn workpiece can be removed into the normal position. After placing new workpiece cuts upon the workpiece holding plate 60 and clamping them by means of the clamping arms 94, the sewn workpiece 42 being clamped to the underside of the workpiece holding plate 60 is released from the lower clamping arms 95 in order to drop the workpiece downwards upon a stack or into a container (not shown).

During shifting of the workpiece holding plate 60 to the workpiece clamping holders, the swingable stop 72 with its bearing surface 76 determining the position of the lateral workpiece edge 77, will be swung into the dotted line position (FIG. 1) by means of the spring 79 in order to prevent a contact with the clamping plate 40. During laying workpiece cuts 42 upon the workpiece holding plate 60 of the inserting device 59, the sewing machine 8 controlled and moved by the magnetic roller 56, which rolls along the master cams 54, 55 and the bridging rail 58, is moved from one end of the cam to the other cam, in order to join the workpiece cuts 42.

To adjust the device to any different workpiece length, first the limit stop carrier 21 must be turned until the adjustable limit stop 34 with the stop screw 36 destining the desired length of the workpiece, lies in the path of motion of the stop 37 abuts against the stop screw 36 of the limit stop 34. At this, simultaneously the right movable clamping half 43 disposed on the carrier body 12, the master cam half 55 located below the movable workpiece clamping half 43 and the plates 84, 85 with the stops 73, 74 and the right clamping arms 94, 95 are displaced in accordance to the longer workpiece to be sewn.

What we claim is:

1. A sewing device with guided control of a sewing cycle, comprising, in combination a support means, a sewing machine having a reciprocating needle, movable carrier means for said sewing machine, an adjustable master cam consisting of two halves having a peripheral edge and a bridging rail overlapping said two halves, for forming a continuous cam edge for said master cam, a driven roller secured to said movable carrier means for said sewing machine and engaged with said peripheral edge of said master cam and coaxial with said needle, a bipartite workpiece clamping means having left lower and upper clamping plates, right lower and upper clamping plates, and lifting means for said left and right upper clamping plates, a stationary carrier body for receiving one of said two master cam halves and said left lower and upper clamping plates, a slidable carrier body for receiving the second half of said two master cam halves and said right lower and upper clamping plates, and provided with stop means, a rod secured to said support means for slidably receiving said slidable carrier body, a limit stop carrier pivoted on said rod, a plurality of adjustable limit stops of different lengths circularly attached to said limit stop carrier and cooperating with said stop means of said slidable carrier body, and means for intermittently revolving said limit stop carrier about said rod.

2. A sewing device as claimed in claim 1, further comprising a workpiece loading and removing apparatus including a workpiece holding plate, means for moving said workpiece holding plate into said workpiece clamping means above a sewn workpiece when said upper clamping plates are in a lifted position, upper clamping means for fastening workpiece cuts to be sewn onto the upper side of said workpiece holding plate during moving it into said opened workpiece clamping means, lower clamping means for clamping a sewn workpiece to the underside of said workpiece holding plate after moving the same into said opened workpiece clamping means, and actuating means for lifting said upper clamping means from said workpiece cuts after moving said workpiece holding plate into said workpiece clamping means and simultaneously forcing said lower clamping means into engagement with said sewn workpiece and said underside of said workpiece holding plate, for removing said sewn workpiece out of said workpiece clamping means.

3. In a sewing device as claimed in claim 2, wherein one pair of said upper and lower clamping means is stationarily arranged on said workpiece holding plate for clamping the left half of workpiece cuts and sewn workpieces, and a second pair of upper and lower clamping means is movably received in said workpiece holding plate for clamping the right half of workpiece cuts and sewn workpieces, means for adjusting said second pair of upper and lower clamping means corresponding to the sizes of workpiece cuts to be sewn, said adjusting means being in connection with said slidable carrier body.

4. A sewing device as claimed in claim 2, wherein said upper and lower clamping means include a block, a shaft pivoted in said block, an upper clamping arm having a bent end, said arm being secured to one end of said shaft and provided with a thrust piece at its bent end, a lower clamping arm having a bent end, said arm being secured to the other end of said shaft and extending through a recess formed in said workpiece holding plate and carrying a thrust piece at its bent end, for cooperating with the upper side of said workpiece holding plate, and driving means for swivelling said shaft, for alternately pressing said thrust piece of said upper clamping arm against the upper side of said workpiece holding plate and said thrust piece of said lower clamping arm against the under side of said workpiece holding plate.

* * * * *